US010639807B2

(12) United States Patent
Wilson et al.

(10) Patent No.: US 10,639,807 B2
(45) **Date of Patent: *May 5, 2020**

(54) MAGNETIC ATTACHMENT FOR SHAVING CARTRIDGE

(71) Applicant: SHAVELOGIC, INC., Dallas, TX (US)

(72) Inventors: Robert A. Wilson, Dallas, TX (US); Craig A. Provost, Boston, MA (US); John W. Griffin, Moultonborough, NH (US)

(73) Assignee: Shavelogic, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/251,874

(22) Filed: Jan. 18, 2019

(65) Prior Publication Data

US 2019/0152080 A1 May 23, 2019

Related U.S. Application Data

(63) Continuation of application No. 14/270,792, filed on May 6, 2014, now Pat. No. 10,350,774, which is a (Continued)

(51) Int. Cl.

| | |
|---|---|
| ***B26B 21/52*** | (2006.01) |
| ***B26B 21/22*** | (2006.01) |
| ***B26B 21/14*** | (2006.01) |

(52) U.S. Cl.

CPC ..... *B26B 21/521* (2013.01); *B26B 21/14* (2013.01); *B26B 21/225* (2013.01); *Y10T 83/9459* (2015.04)

(58) Field of Classification Search

CPC ..... B26B 21/00; B26B 21/14; B26B 21/22; B26B 21/222; B26B 21/225; (Continued)

(56) References Cited

U.S. PATENT DOCUMENTS

| | | | |
|---|---|---|---|
| 1,299,095 | A | 4/1919 | Ames |
| 1,299,096 | A | 4/1919 | Ames |

(Continued)

FOREIGN PATENT DOCUMENTS

| | | |
|---|---|---|
| BR | 9905745 | 9/2000 |
| CN | 1807197 | 7/2006 |

(Continued)

OTHER PUBLICATIONS

Certified Translation of CN 101612740, published Dec. 30, 2009, Jian et al.

(Continued)

*Primary Examiner* — Phong H Nguyen
(74) *Attorney, Agent, or Firm* — Leber IP Law; Celia H. Leber

(57) ABSTRACT

Shaving systems are disclosed that include a replaceable shaving assembly and a cartridge connecting structure for connecting the shaving assembly to a handle. In preferred implementations, the cartridge connecting structure has a magnetic portion configured to help draw the cartridge onto the handle and retain the cartridge in place when the razor is not in contact with the skin, and a mechanical engagement that provides the necessary retention forces required to keep the system intact during shaving.

7 Claims, 10 Drawing Sheets

Related U.S. Application Data continuation of application No. 13/938,638, filed on Jul. 10, 2013, now Pat. No. 8,789,282, which is a continuation of application No. PCT/US2013/042038, filed on May 21, 2013.

(60) Provisional application No. 61/651,732, filed on May 25, 2012.

(58) Field of Classification Search

CPC ..... B26B 21/227; B26B 21/30; B26B 21/40; B26B 21/4037; B26B 21/52; B26B 21/521; B26B 21/522; Y10T 83/9457; Y10T 83/9459

USPC ... 30/32, 40, 40.2, 51, 57, 67, 74, 526, 527, 30/531, 532, 537, 541, FOR. 100, 30/FOR. 102, FOR. 104, FOR. 105

See application file for complete search history.

(56) References Cited

U.S. PATENT DOCUMENTS

| | | | |
|---|---|---|---|
| 1,299,097 | A | 4/1919 | Ames |
| 2,532,372 | A | 11/1948 | Sanders |
| 2,885,778 | A | 5/1959 | Randol |
| 2,967,354 | A | 1/1961 | Ahlborn |
| 3,031,757 | A | 5/1962 | Kramer |
| 3,067,513 | A | 12/1962 | Randol |
| 3,660,894 | A | 5/1972 | Sand |
| 3,768,162 | A | 10/1973 | Perry |
| 3,783,510 | A | 1/1974 | Dawidowicz et al. |
| 4,211,456 | A | 7/1980 | Sears |
| 4,413,411 | A | 11/1983 | Trotta |
| 4,446,619 | A | 5/1984 | Jacobson |
| 4,574,625 | A | 3/1986 | Olasz et al. |
| 5,129,118 | A | 7/1992 | Walmesley |
| 5,146,814 | A | 9/1992 | Vasichek |
| 5,526,568 | A | 6/1996 | Copelan |
| 5,787,586 | A | 8/1998 | Aprille et al. |
| 5,822,869 | A | 10/1998 | Metcalf et al. |
| 5,848,475 | A | 12/1998 | Hill et al. |
| 5,921,562 | A | 7/1999 | Robison |
| 5,956,851 | A | 9/1999 | Apprille, Jr. et al. |
| 6,026,577 | A | 2/2000 | Ferraro |
| 6,035,535 | A | 3/2000 | Dischler |
| 6,203,644 | B1 | 3/2001 | Nagaura et al. |
| 6,237,232 | B1 | 5/2001 | Petricca et al. |
| 6,530,151 | B2 | 3/2003 | Kameka |
| 6,565,586 | B2 | 5/2003 | Harrold et al. |
| 6,760,941 | B2 | 7/2004 | Coleman, Jr. |
| 6,886,262 | B2 | 5/2005 | Ohtsubo et al. |
| 7,134,368 | B2 | 11/2006 | Nagy |
| 7,162,802 | B2 | 1/2007 | Benardeau et al. |
| 7,168,173 | B2 | 1/2007 | Worrick, III |
| 7,181,800 | B2 | 2/2007 | Lee |
| 7,197,825 | B2 | 4/2007 | Walker |
| 7,275,461 | B2 | 10/2007 | Gherman et al. |
| 7,337,903 | B2 | 3/2008 | Lauri |
| 7,448,135 | B2 | 11/2008 | Zhuk |
| 7,530,771 | B2 | 5/2009 | Kozak |
| 7,578,062 | B2 | 8/2009 | Blackburn |
| 7,621,203 | B2 | 11/2009 | Aviza |
| 7,703,361 | B2 | 4/2010 | Johnson et al. |
| 7,765,700 | B2 | 8/2010 | Aviza |
| 7,770,294 | B2 | 8/2010 | Bruno et al. |
| 7,895,754 | B2 | 3/2011 | Blackburn |
| 7,913,393 | B2 | 3/2011 | Royle et al. |
| 8,381,406 | B2 | 2/2013 | Miyazaki |
| 8,567,966 | B2 | 10/2013 | Hubbs |
| 8,671,577 | B2 | 3/2014 | Brown |
| 8,789,282 | B2 | 7/2014 | Wilson et al. |
| 9,498,892 | B2 | 11/2016 | Nakasuka et al. |
| 2003/0204915 | A1 | 11/2003 | Colemen, Jr. |
| 2005/0193572 | A1 | 9/2005 | Gilder |
| 2007/0033806 | A1 | 2/2007 | Orloff et al. |
| 2007/0182109 | A1 | 8/2007 | Considine et al. |
| 2010/0037463 | A1 | 2/2010 | Maichel et al. |
| 2010/0083505 | A1 | 4/2010 | Royle et al. |
| 2010/0122709 | A1 | 5/2010 | Janatpour et al. |
| 2010/0139103 | A1 | 6/2010 | Miyazaki et al. |
| 2011/0016724 | A1 | 1/2011 | Murgida |
| 2011/0088269 | A1 | 4/2011 | Walker et al. |
| 2012/0036658 | A1 | 2/2012 | Schaefer et al. |
| 2012/0311865 | A1 | 12/2012 | Hamilton et al. |
| 2013/0312265 | A1 | 11/2013 | Wilson et al. |
| 2014/0116211 | A1 | 5/2014 | Griffin et al. |
| 2015/0174775 | A1 | 6/2015 | Hodgson |
| 2015/0174776 | A1 | 6/2015 | Hawes |

FOREIGN PATENT DOCUMENTS

| | | | |
|---|---|---|---|
| CN | 101612740 | | 12/2009 |
| CN | 201456045 | | 5/2010 |
| CN | 102271876 | | 12/2011 |
| DE | 102009050344 | | 5/2011 |
| EP | 0300478 | A2 | 1/1989 |
| EP | 0885697 | | 10/2003 |
| EP | 2227360 | | 9/2010 |
| FR | 2660589 | | 10/1991 |
| FR | 2663255 | | 12/1991 |
| GB | 143536 | | 10/1923 |
| GB | 512440 | | 9/1939 |
| JP | 1996323065 | | 12/1996 |
| JP | 2001340671 | | 12/2001 |
| JP | 2004033295 | | 2/2004 |
| JP | 2005000303 | | 1/2005 |
| JP | 2006314720 | | 11/2006 |
| RU | 2093349 | | 10/1997 |
| WO | 9836880 | | 8/1998 |
| WO | 2010078564 | | 7/2010 |
| WO | 2012054267 | | 4/2012 |

OTHER PUBLICATIONS

Chinese Patent Application No. 2017100644835, Office Action with English Translation, dated Feb. 1, 2018.

Chinese Patent Application No. 2017100644835, Search Report dated Jan. 17, 2018.

European Patent Application No. 13794165, Search Report dated Jul. 20, 2016, 6 pages.

European Patent Application No. 13849856, Search Report dated Jun. 3, 2016, 8 pages.

Magnet in Safety Razor Handle Picks Up Blade from Basin, Popular Science, Oct. 1941, http://books.google.com/.

Petition for Inter Partes Review of U.S. Pat. No. 8,789,282 Under 35 U.S.C. Sec. 312 and 37 C.F.R. Sec. 42.104, dated Mar. 10, 2016, 59 pages.

Razor Emporium, http:J/razoremporium.com/store/index.php?main_page=product_reviews_info&products id=652&reviews id= 17.

U.S. Appl. No. 14/270,792, Office Action dated Sep. 22, 2017.

European Patent Application No. 13794165.4, Intention to Grant dated Sep. 19, 2018, 28 pages.

International Patent Application No. PCT/US2013/042038 International Search Report and Written Opinion dated Aug. 21, 2013, 6 pages.

FIG. 2A
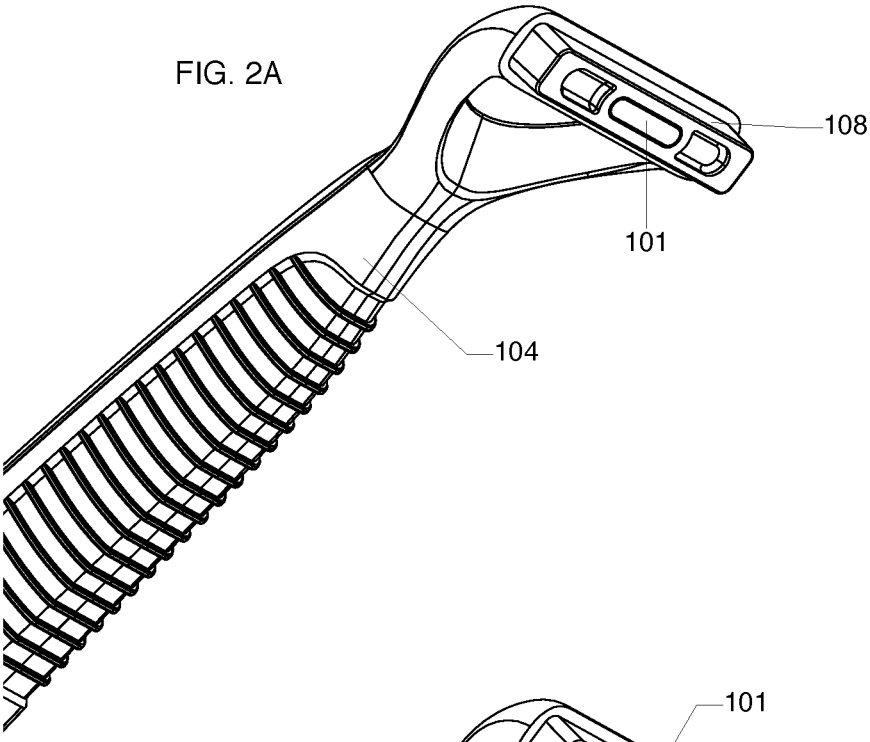
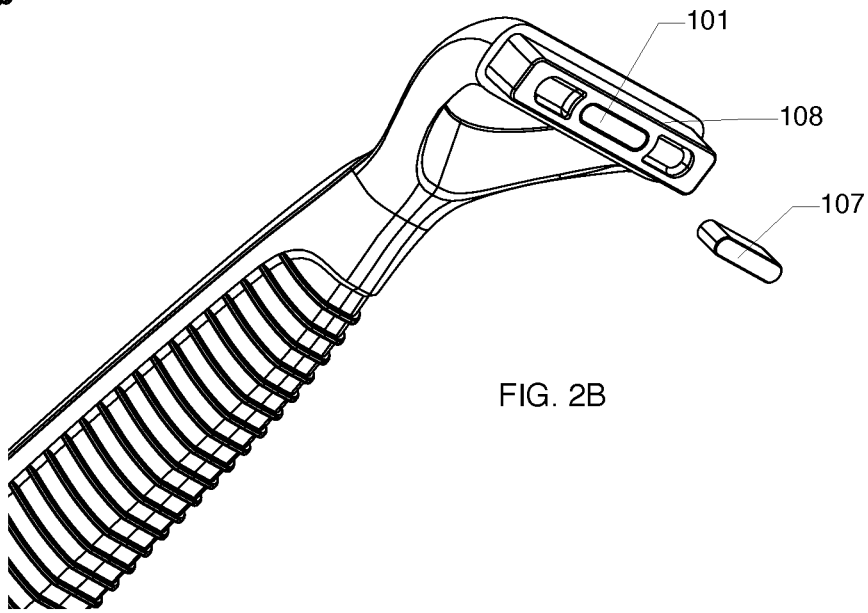
FIG. 2B

MAGNETIC ATTACHMENT FOR SHAVING CARTRIDGE

CROSS REFERENCE TO RELATED APPLICATIONS

This patent application is a continuation of U.S. Ser. No. 14/270,792, filed May 6, 2014, which is a continuation of U.S. Ser. No. 13/938,638, file Jul. 10, 2013, now U.S. Pat. No. 8,789,282, granted on Jul. 29, 2014, which is a continuation of International Serial No. PCT/US2013/042038, filed May 21, 2013, which claims priority to U.S. Provisional Application Ser. No. 61/651,732, filed on May 25, 2012. The entirety of each of these applications is hereby incorporated by reference herein.

BACKGROUND OF THE INVENTION

The invention relates to shaving systems having handles and replaceable cartridges.

Shaving systems often consist of a handle and a replaceable cartridge in which one or more blades are mounted in a plastic housing. After the blades in a cartridge have become dull from use, the cartridge is discarded, and replaced on the handle with a new cartridge.

"Cartridge-type" shaving systems, using a variety of proprietary connection schemes to affix the cartridge to the handle, have become popular. This is partially driven by a razor manufacturer's desire to have a proprietary connection, thereby encouraging repeat purchases. The connection scheme allows the consumer to easily, repeatedly, efficiently and intuitively load and remove the new and used cartridges from the handle and provides the necessary retention forces to maintain the integrity of the handle-to-cartridge attachment during shaving.

The connection scheme must be robust enough to provide the necessary retention forces to maintain the integrity of the handle-to-cartridge attachment during shaving. To date the industry has widely embraced complicated mechanical loading and unloading mechanisms and release buttons to try to achieve this objective. There is a need for a simpler, more intuitive and reliable shaving handle-to-cartridge connection method.

SUMMARY OF THE INVENTION

The invention features, in general, shaving systems that include a replaceable shaving assembly and a connecting structure for connecting the shaving assembly to a handle. In preferred implementations, the cartridge connecting structure has a magnetic portion configured to help draw the cartridge onto the handle and retain the cartridge in place when the razor is not in contact with the skin, and a mechanical engagement that provides the necessary retention forces required to keep the system intact during shaving. In some cases, the mechanical engagement includes an appendage on the end of the razor handle and a mating receiver on the shaving assembly that have been designed at appropriate angles such that the loads applied to the cartridge during shaving push the appendage into the receiver.

In one aspect, the invention features a shaving system comprising a handle, a shaving assembly mounted on the handle, and a magnetic portion configured to provide a magnetic force between the handle and shaving assembly sufficient to retain the shaving assembly on the handle between shaving strokes.

Some implementations include one or more of the following features.

The shaving assembly may include an interface element configured to provide a mechanical engagement between the shaving assembly and handle. The interface element and a distal portion of the handle may be configured to retain the shaving assembly on the handle when a shaving surface of the shaving assembly is in contact with a user's skin. The handle has a distal end and a proximal end, and may include an appendage protruding from the distal end, and the shaving assembly may include an interface element having a receiving portion configured to receive the appendage. Alternatively, the handle may include a receiving portion at the distal end, and the shaving assembly may include an appendage configured to be received in the receiving portion.

In some cases, the magnetic portion comprises at least one magnet affixed to the end of the appendage, and the receiving portion includes a ferrous material. Alternatively, the magnet may be positioned in the receiving portion, and the appendage may include a ferrous material.

The appendage may be disposed so that a long axis of the appendage is at an angle of +30 degrees to −30 degrees with respect to a crossbar center of the handle, and the handle further includes a generally planar rim surface surrounding the appendage that is configured to engage a corresponding rim surface on the interface element when the shaving assembly is mounted on the handle. In such cases, the rim surface on the handle may be disposed at an angle of about 10 to 20 degrees with respect to a longitudinal axis of inertia of the handle.

The shaving assembly generally includes a blade unit, which may be mounted on the handle with a pivoting connection. The pivoting connection between the handle and blade unit may be configured to allow a user to rotate the handle between approximately 15 to 105 degrees from a reference skin plane during shaving.

In some cases, the interface element includes tabs that are configured to be grasped by a user to facilitate removal of the shaving assembly from the handle. These tabs may also provide the user with a visual cue to assist the user in removal of the shaving assembly.

In another aspect, the invention features a shaving system that includes a handle and a shaving assembly mounted on the handle, the shaving assembly comprising an interface element configured to provide a mechanical engagement between the shaving assembly and handle. The interface element and a distal portion of the handle include male and female portions configured such that shaving forces act through the male portion to retain the shaving assembly on the handle when a shaving surface of the shaving assembly is in contact with a user's skin.

Some implementations of this aspect include one or more of the following features. The handle has a distal end and a proximal end, and may include an appendage protruding from the distal end, and the shaving assembly may include an interface element having a receiving portion configured to receive the appendage. Alternatively, the handle may include a receiving portion at the distal end, and the shaving assembly may include an appendage configured to be received in the receiving portion.

The appendage may be disposed so that a long axis of the appendage is at an angle of +30 degrees to −30 degrees with respect to a crossbar center of the handle, and the handle further includes a generally planar rim surface surrounding the appendage that is configured to engage a corresponding rim surface on the interface element when the shaving assembly is mounted on the handle. In such cases, the rim surface on the handle may be disposed at an angle of about 10 to 20 degrees with respect to a longitudinal axis of inertia of the handle.

The shaving assembly generally includes a blade unit, which may be mounted on the handle with a pivoting connection. The pivoting connection between the handle and blade unit may be configured to allow a user to rotate the handle between approximately 15 to 105 degrees from a reference skin plane during shaving.

In some cases, the interface element includes tabs that are configured to be grasped by a user to facilitate removal of the shaving assembly from the handle. These tabs may also provide the user with a visual cue to assist the user in removal of the shaving assembly.

The invention also features methods of mounting a shaving assembly on the handle of a shaving system using the magnetic force discussed herein, and methods of shaving using the shaving systems disclosed herein.

Embodiments of the invention may include one or more of the following advantages. The use of a magnetic portion to provide the necessary force to permit the cartridge to be drawn onto the handle, and the use of a unique mechanical engagement to retain the cartridge in place during shaving, results in easy loading of cartridges with little likelihood of unintended detachment during use. In addition, the cartridge can be released and removed from the handle by simply applying a small force.

Preferred implementations of the present invention provide a shaving system comprised of a handle and a disposable cartridge that is easy to load and unload, yet robust enough to provide the necessary retention forces to maintain the integrity of the handle-to-cartridge attachment during shaving. Due to the relatively simple configuration of the handle-to-cartridge connection, preferred shaving systems are easily assembled and thus cost-effective to manufacture.

Other features and advantages of the invention will be apparent from the following description of embodiments thereof and from the claims.

BRIEF DESCRIPTION OF THE DRAWINGS

For a more complete understanding of this disclosure and its features, reference is now made to the following description, taken in conjunction with the accompanying drawings, in which:

FIGS. 2A and 2B are perspective views of the handle of the shaving system shown in FIG. 1, with the magnet exploded from the handle in FIG. 2B.

In FIG. 3B the ferrous strip is exploded from the magnetic receiver.

FIG. 9A is an exploded perspective view of the system, FIG. 9B is a perspective view of the handle only, and FIG. 9C is a cross-sectional side view of the shaving system, taken along the long axis of the shaving system.

DETAILED DESCRIPTION

The present disclosure relates generally to consumer products and, in particular, to shaving systems with interchangeable cartridge systems, referred to herein as shaving assemblies. As discussed above, in preferred systems a magnet provides the necessary force to draw the cartridge onto the handle and to retain the cartridge on the handle when shaving is not taking place (e.g., between shaving strokes, during rinsing, and when the shaving system is not in use), and a mechanical engagement is used to retain the cartridge in place when the shaving assembly is in contact with the skin during shaving.

Figure 1:
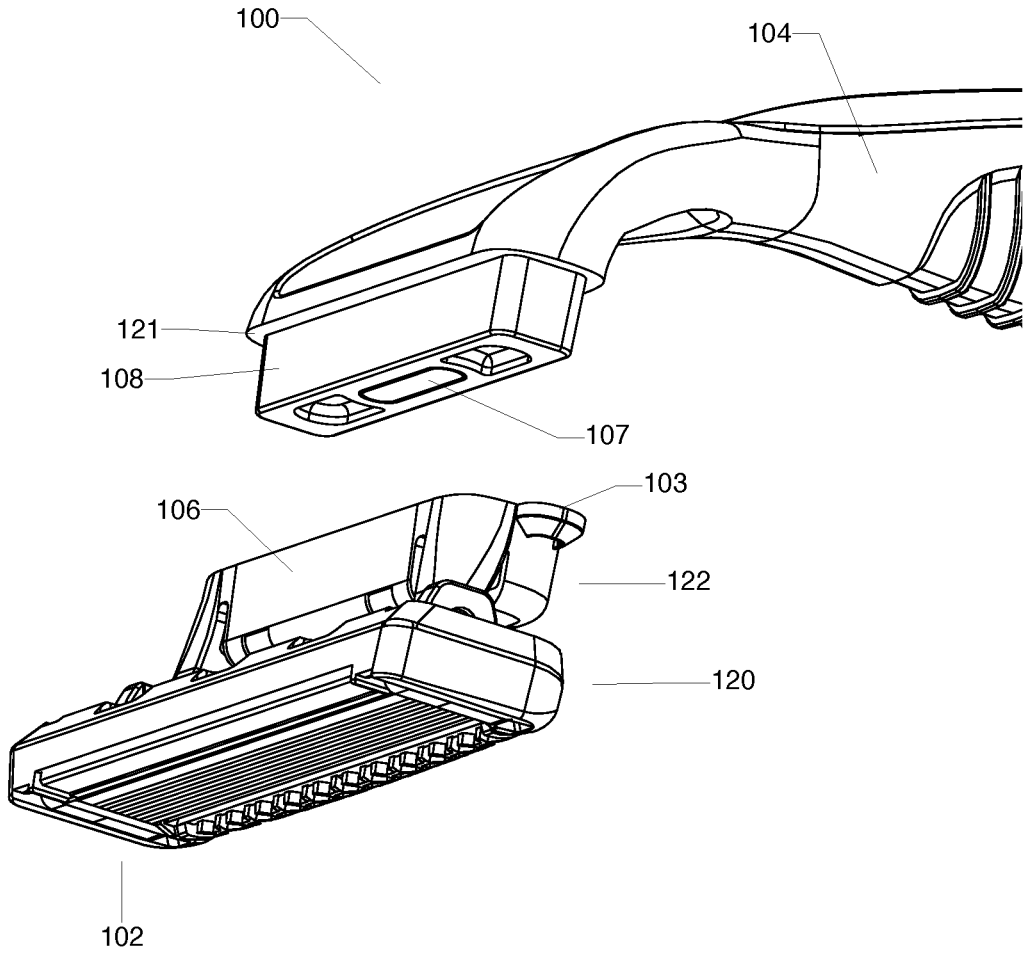
FIG. 1 is a perspective view of a shaving system according to one embodiment.

While shaving systems will be described below, it is noted that the magnetic portion and/or the mechanical engagement described herein could be used in any suitable consumer product system, including but not limited to consumer products, personal hygiene products (e.g., a toothbrush or hairbrush), reusable shaving systems, interchangeable depilatory systems, and grooming systems. It should also be understood that system 100 shown in FIG. 1 is for illustrative purposes only and that any other shaving system or hair-removing system or subsystem could be used in conjunction with or in lieu of system. Preferred shaving systems are safety razors with a replaceable cartridge-type blade scheme.

Figure 3A:
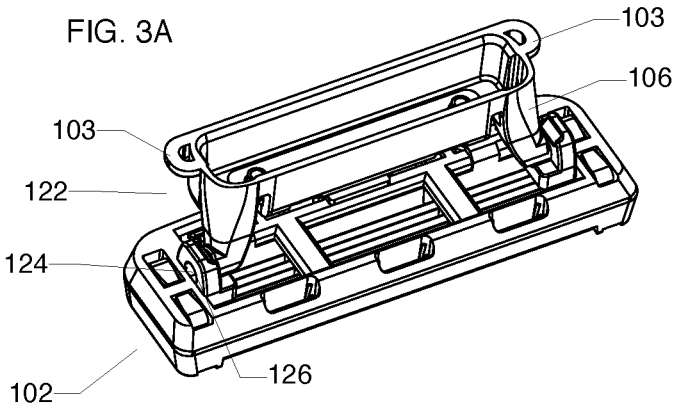
FIGS. 3A and 3B are perspective views of the shaving assembly of the system shown in FIG. 1.
Figure 3B:
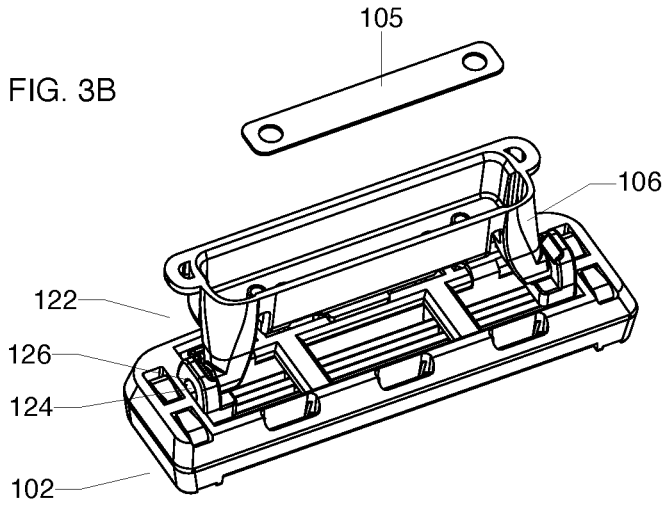
Figure 4:
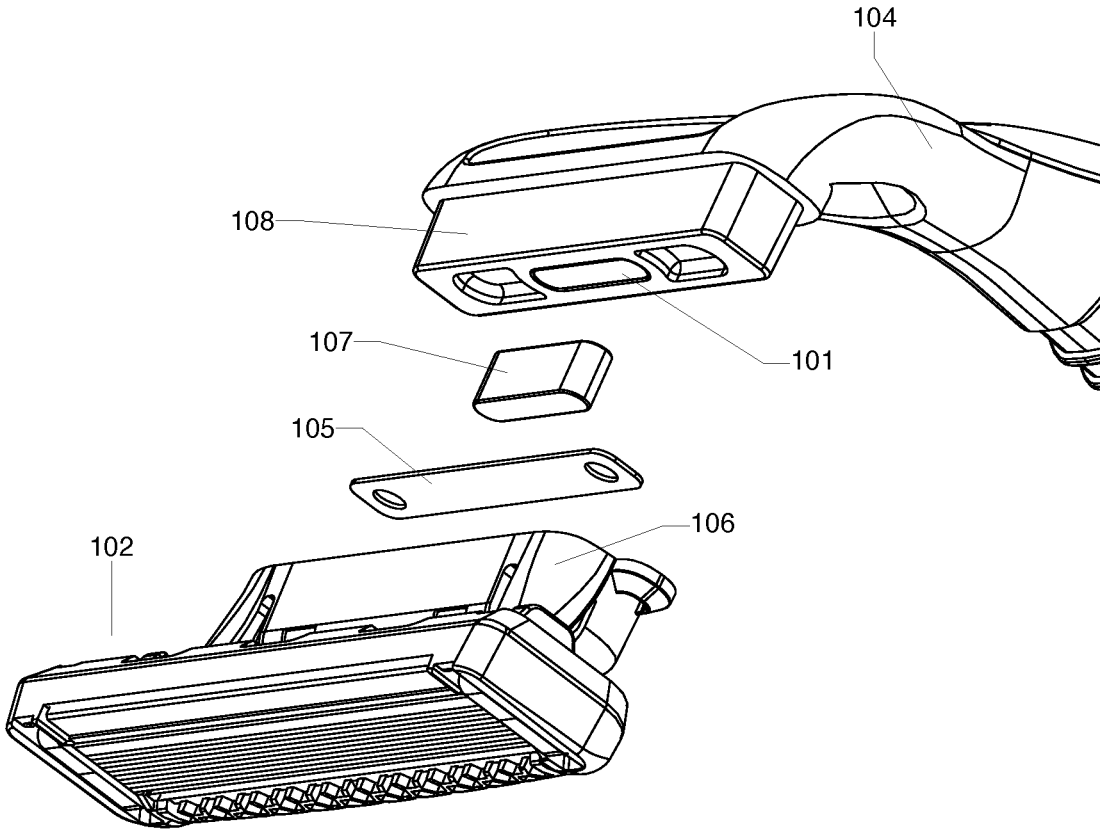
FIG. 4 is an exploded perspective view of the system shown in FIG. 1.

Referring to FIG. 1, a shaving system 100 according to one embodiment includes a shaving assembly 120 that is removably mounted on a handle 104. As is well known, the shaving assembly and handle can be sold as a kit and/or separately. The shaving assembly 120 includes a blade unit 102 that includes one or more blades. The blade unit 102 is pivotally mounted on the handle 104 via an interface element 122 which includes fingers 124 that are received in pivotal engagement in bores 126 on the blade unit (see FIGS. 3A-3B), as is well known in the shaving system art. The interface element also defines a magnetic receiver 106 in the form of a hollow, central cavity. Tabs 103 are provided on either side of the interface element 122 to help the user to separate the shaving assembly from the handle 104 by providing a positive grasping surface when the shaving assembly 120 is to be replaced. The tabs also may give the user a visual indication of how to remove the interface element from the handle.

The interaction of the interface element 122 with the handle 104 provides both the magnetic force and the mechanical engagement discussed above. The magnetic force is provided by the interaction of a ferrous strip 105 (FIGS. 3A-3B) that is positioned within the magnetic receiver 106, with a magnet 107 that is mounted on an appendage 108 of the handle 104. The attractive force between the magnet 107 and ferrous strip 105 is sufficient to draw the interface element onto the appendage when the user wishes to replace the shaving assembly 120, yet is weak enough to allow the shaving assembly 120 to be easily removed from the handle for replacement. The magnetic force also is sufficient to hold the shaving assembly in place on the handle when the mechanical engagement, which is produced by shaving forces, is not doing so—for example when the user is rinsing the blade unit and between shaving strokes.

As shown in FIGS. 2A and 2B, the magnet 107 can be positioned within a recess 101 in appendage 108 and held securely in place, for example via a press fit, or with adhesive or other assembly techniques. The ferrous strip 105 can be attached to the receiver 106 by any suitable assembly technique including, for example, crimping, riveting, adhesive, and other commonly practiced attachment methods.

The ferrous strip 105 can be of any suitable size, shape, configuration, or structure, as long as its interaction with the magnet 107 provides a sufficient magnetic force. In one embodiment, the ferrous strip 105 can include a ferrous material or ferromagnetic material, such as nickel or cobalt or their alloys, or be of any material that can be attracted to a magnet.

The magnet 107 can be selected from any magnetic material, e.g. "permanent" magnets, rare earth magnets, ceramic magnets, Mn—Al alloy magnets, electromagnets, etc. Preferably the magnet 107 includes a magnetic material selected from the group consisting of ceramic magnets, rare earth magnets, or combinations thereof. Most preferably, the magnet is a rare earth magnet selected from Neodymium Iron Boron, Samarium Cobalt, AlNiCo, and mixtures thereof.

In some embodiments, the ferrous strip 105 can have an elongated shape with rounded edges and a relatively flat surface, e.g., as shown in FIG. 1. In other embodiments, the ferrous strip could be configured to cover the entire interior surface of the recessed area of the magnetic receiver 106, or portions thereof, such as a portion of the sidewalls of the magnetic receiver 106.

Corrosion of the ferrous strip is a concern due to the wet environment razors are expected to endure. Preferably, the ferrous strip is either made of a magnetic grade of stainless steel, or an ordinary grade of ferric steel or other ferric metal that is treated to impart corrosion resistance. For example, the metal may be plated. e.g., with nickel, or coated with a protective coating, such as paint or epoxy. In another embodiment the metal may be molded into the magnetic receiver.

Figure 5A:
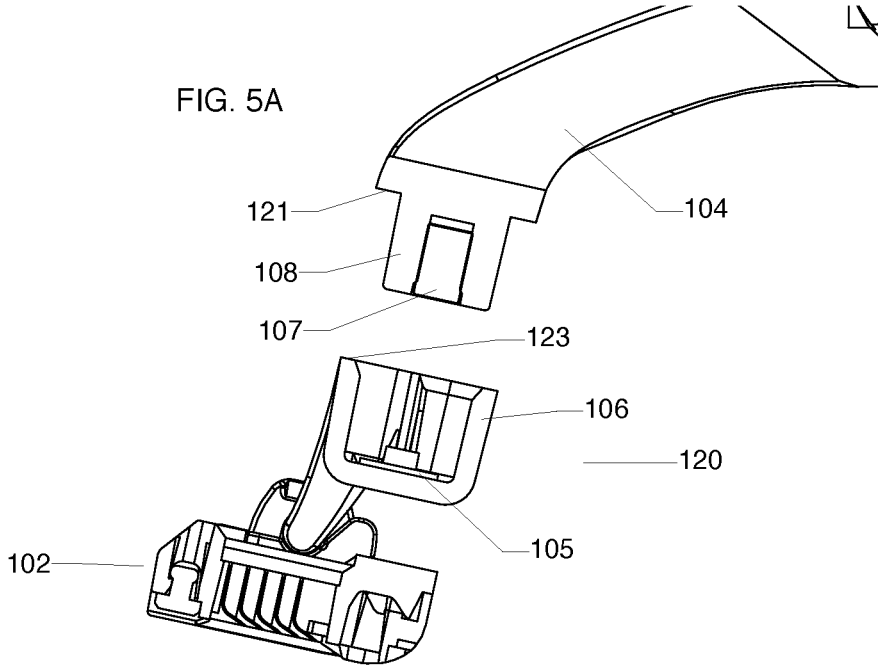
FIGS. 5A and 5B are cross-sectional views of the system shown in FIG. 1, taken along the long axis of the shaving system, with the shaving assembly being shown exploded from the handle and attached thereto, respectively.
Figure 5B:
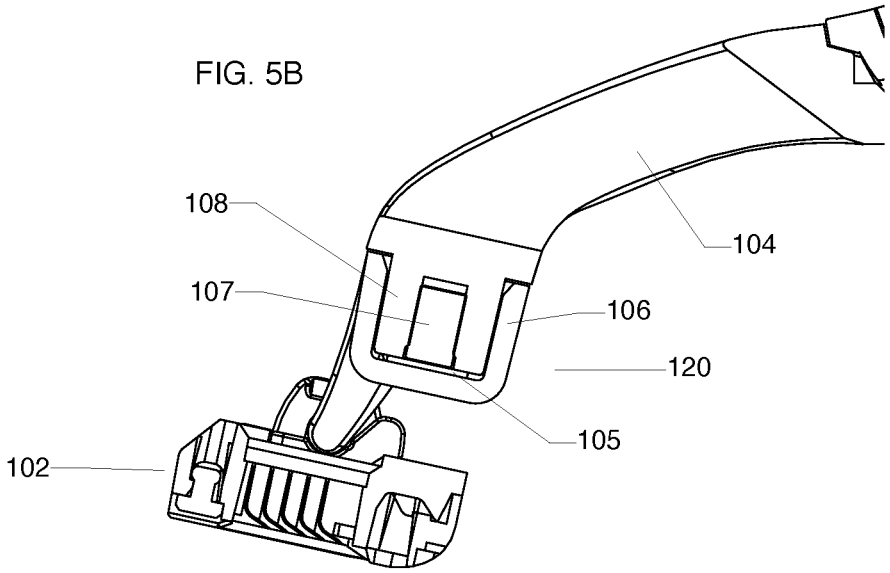

As shown in FIGS. 5A and 5B, when a new shaving assembly 120 is to be mounted on handle 104, the appendage 108 is inserted into the magnetic receiver 106, with the magnetic attraction between the magnet 107 and the ferrous strip 105 serving to draw the two parts together and hold them in engagement. When the appendage 108 is received in the receiver 106, a rim 121 on the handle, surrounding the appendage, makes contact with a corresponding rim 123 on the receiver 106, as shown in FIG. 5B When a shaving load is applied to the shaving assembly, the engagement between the appendage and receiver is maintained primarily by the mechanical engagement, which is designed to absorb the forces that occur during shaving, with the magnetic force providing some supplemental retention force. In preferred implementations, the mechanical engagement is configured to retain the shaving assembly in place—even in the absence of the magnetic force (e.g., if the magnet and ferrous strip are omitted for purposes of testing)—during all normal shaving loads once the blade unit is placed in contact with the skin. In most implementations, the mechanical engagement is not designed to hold the cartridge onto the handle between shaving strokes. Once the blade unit is lifted off the skin the magnetic force is then required to overcome the gravitational forces of the cartridge, preventing the magnetic receiver from falling off of the handle appendage.

Figure 6A:
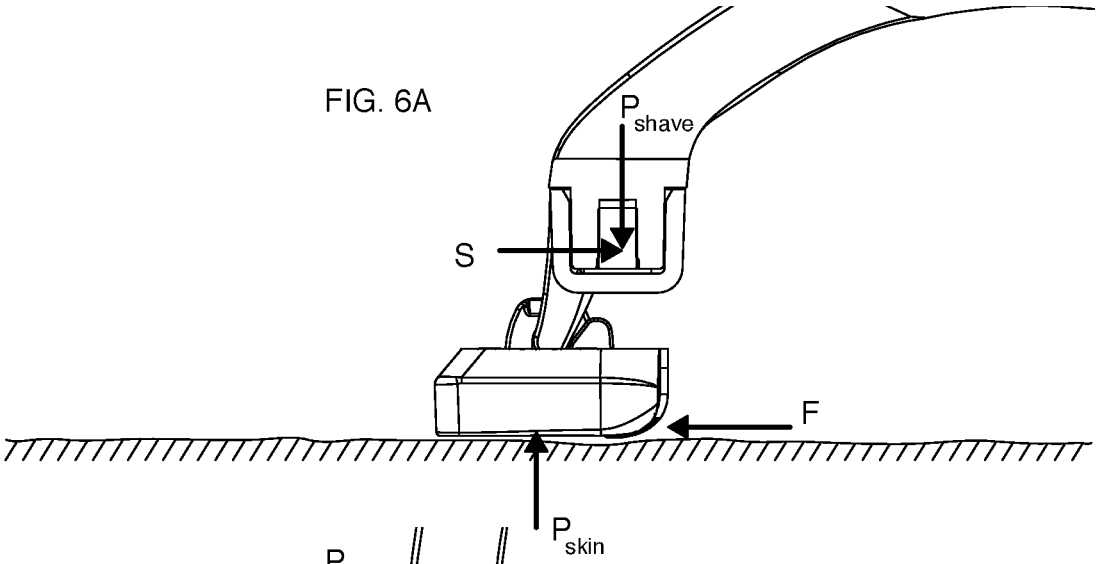
FIGS. 6A-6C are diagrammatic views illustrating the forces that generally act upon the blade unit when the shaving system is in use, with the blade unit in different positions in the various figures.
Figure 6B:
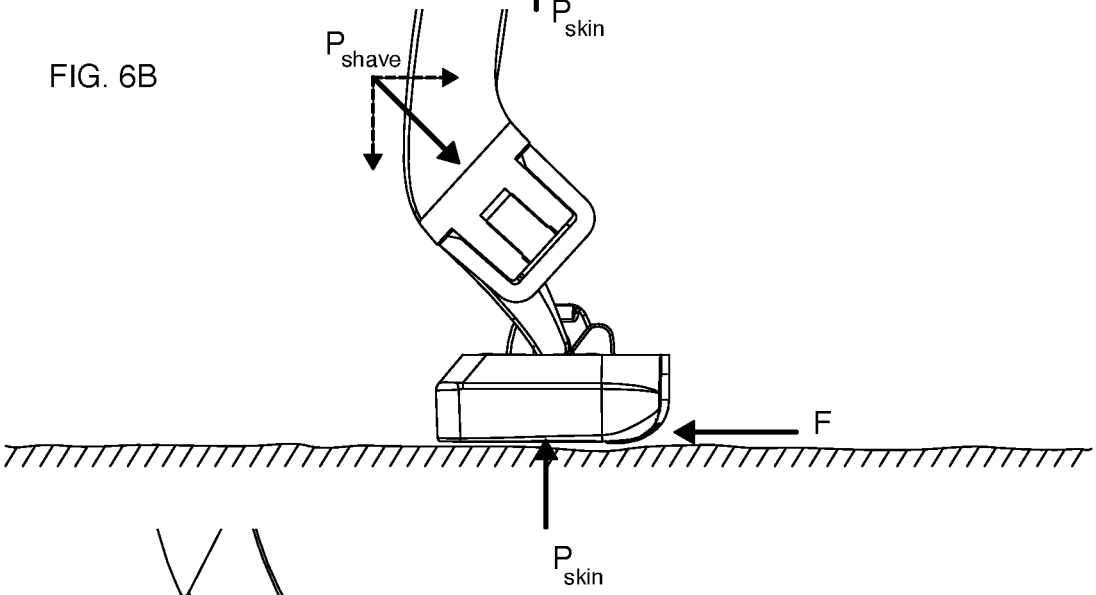
Figure 6C:
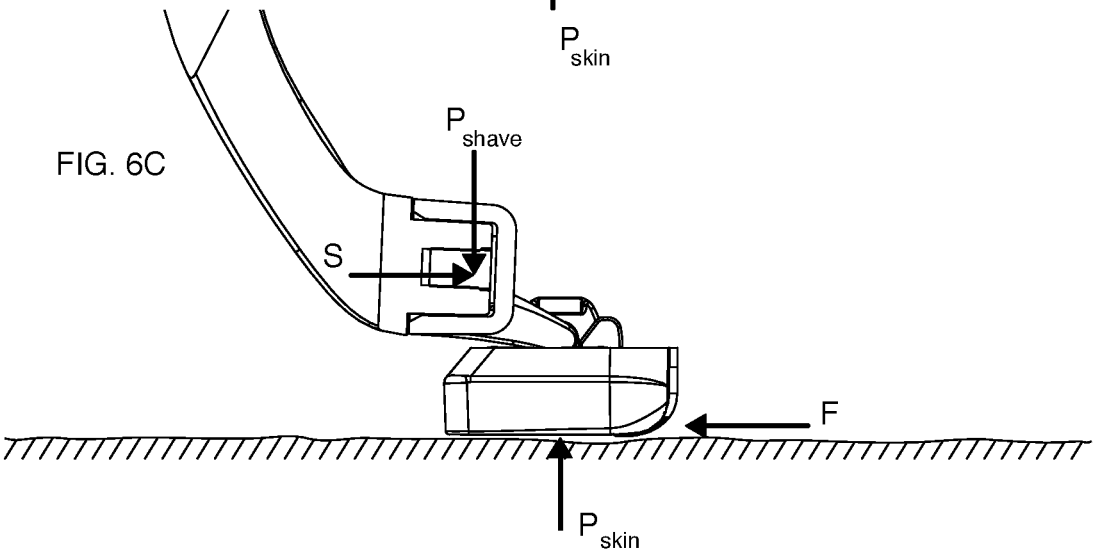

FIGS. 6A-6C are diagrams showing the mechanical forces that are typically applied to and absorbed by the shaving system during shaving (as long as the blade unit is in contact with the user's skin.) Forces exerted generally parallel to the skin surface include a shaving force (S), which is generated by the user pulling the blades across the skin, and typical opposing forces (e.g., friction, drag, skin bulge, and blade cutting forces) (F). Generally perpendicular to these forces are the downward pressure of the blade unit against the skin ($P_{shave}$) and the resisting upward pressure of the user's skin ($P_{skin}$). During shaving, the majority of the forces that must be withstood by the interface between the shaving assembly and handle are those that are generally parallel to the skin surface (forces F and S). The appendage 108 and receiver 106 have been designed to absorb these forces without relative displacement, due to the interaction between these parts as they rotate together during rotation of the handle, which pushes the appendage into the receiver.

Figure 7A:
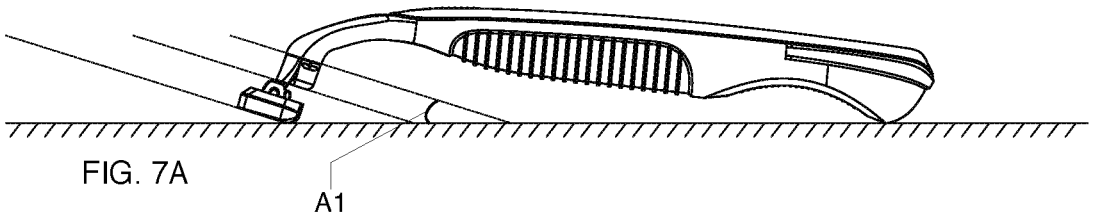
FIGS. 7A-7D are diagrammatic views illustrating the pivot angles typically assumed by the blade unit when the shaving system is at rest and in use.
Figure 7B:
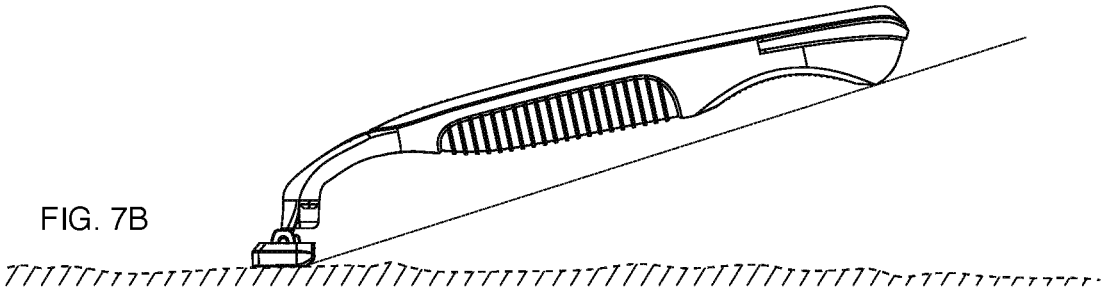

FIGS. 7A-7D illustrate the pivot angles that are commonly assumed by the handle relative to the blade unit during shaving and at rest, illustrating the manner in which the appendage/receiver assembly rotates during use. As shown in FIG. 7A, appendage 108 and receiver 106 are designed to be positioned, at rest, at an angle A1 of approximately 15 degrees from the horizontal plane the blade unit is resting on. Once the cartridge is placed onto the skin (FIGS. 7B and 7C), the pivoting connection between the handle and blade unit will allow the user to continually move/rotate the handle between approximately 15 to 105 degrees from the reference skin plane during shaving (in FIG. 7D, A2=15°, A3=60°, and A4=105°.) These angles are measured between the longitudinal axis of inertia of the handle (see FIG. 7E) and the skin surface.

Figure 7E:
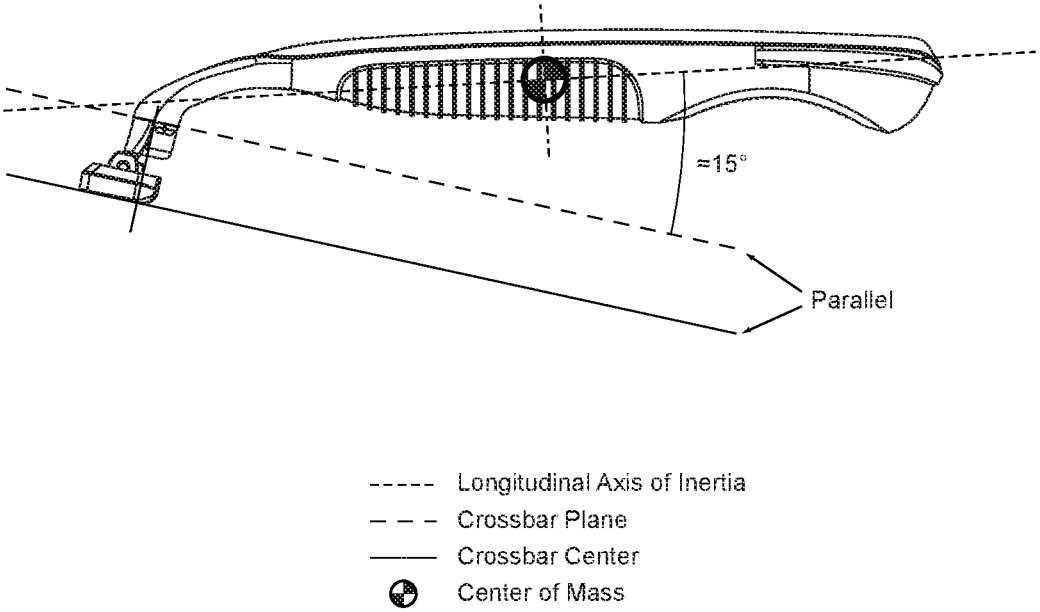
FIG. 7E is a diagram illustrating how the longitudinal axis of inertia of the handle is measured.
Figure 8A:
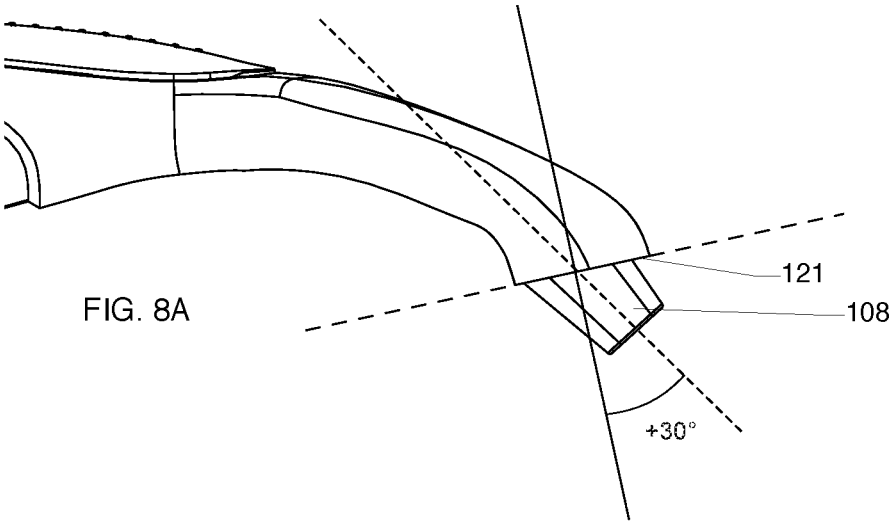
FIGS. 8A-8C shown the angular orientation of the appendage relative to a line perpendicular to the plane of the rim of the handle in three different embodiments.
Figure 8B:
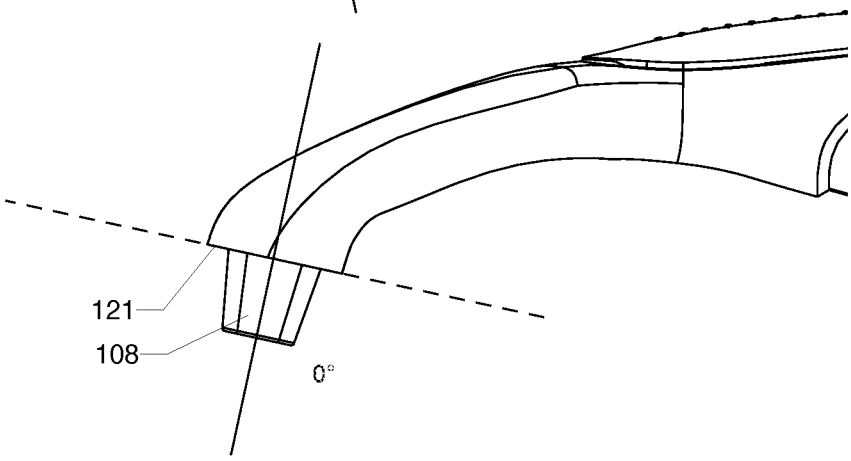
Figure 8C:
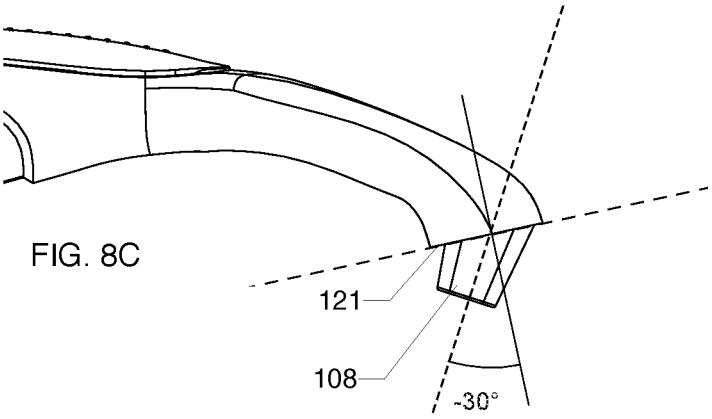

The appendage 108 and receiver 106 are designed so that during shaving (up strokes, down strokes and side stokes) the razor handle appendage 108 and receiver 106 will be able to rotate together, during rotation of the razor handle, without coming apart. This "self-locking" relationship is achieved primarily by (a) the angle of the appendage 108 relative to a line taken perpendicular to the plane of the rim 121 (crossbar plane, FIG. 7E), which in preferred implementations ranges from +35 degrees to −35 degrees, e.g., +30 degrees to −30 degrees as shown in FIGS. 8A-8C, and (b) the angle between the plane of rim 121 (crossbar plane) and the longitudinal axis of inertia as shown in FIG. 7E, which in some implementations is from about 10 degrees to 20 degrees. The angle of the appendage is selected based on balancing the need for relatively easy loading of the shaving assembly onto the handle by a user with a desired level of retention force.

Figure 7C:
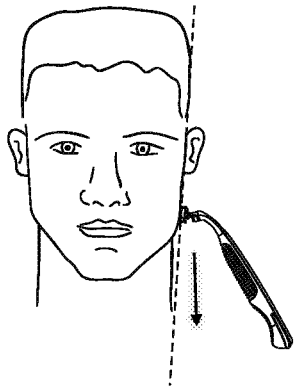
Figure 7D:
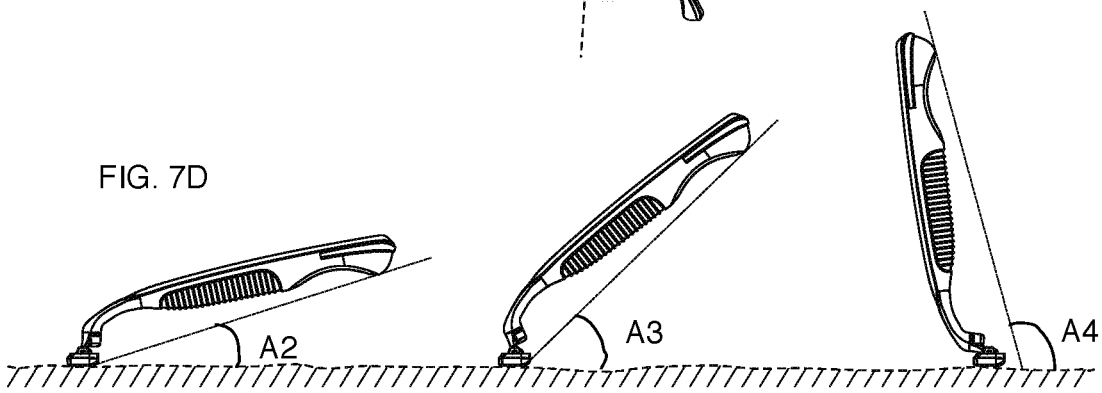

Once the shaving surface of the blade unit is placed in contact with the face (e.g., as shown in FIG. 7C), during shaving the razor handle will rotate between many angles as discussed above. As the razor handle angle increases during shaving strokes, the unique "self locking" mechanical design between the appendage 108 and receiver 106 will actually increase the integrity of the connection between the shaving assembly and handle.

Handle 104 provides an end user with some means to grip or otherwise control system 100. In one embodiment, handle 104 could generally enhance the performance of system 100 by providing the end user with the appropriate amount of leverage to achieve exceptional shaving results, usability, ease of handling, and easy storage. Handle 104 may include a number of ergonomic elements, rubberized material, other features, or any suitable combination thereof to enhance the user's control and handling of system 100. Handle 104 may be of any suitable size, shape, or configuration.

The handle, blade unit, and other rigid plastic parts of the shaving system can be made of any suitable material including, for example, polyethylene terephthalate (PET or PETE), high density (HD) PETE, acrylonitrile butadiene styrene (ABS), thermoplastic polymer, polypropylene, oriented polypropylene, polyurethane, polyvinyl chloride (PVC), polytetrafluoroethylene (PTFE), polyester, high-gloss polyester, or combinations thereof.

Other Embodiments

While this disclosure has described certain embodiments and generally associated methods, alterations and permutations of these embodiments and methods will be apparent to those skilled in the art.

Figure 9A:
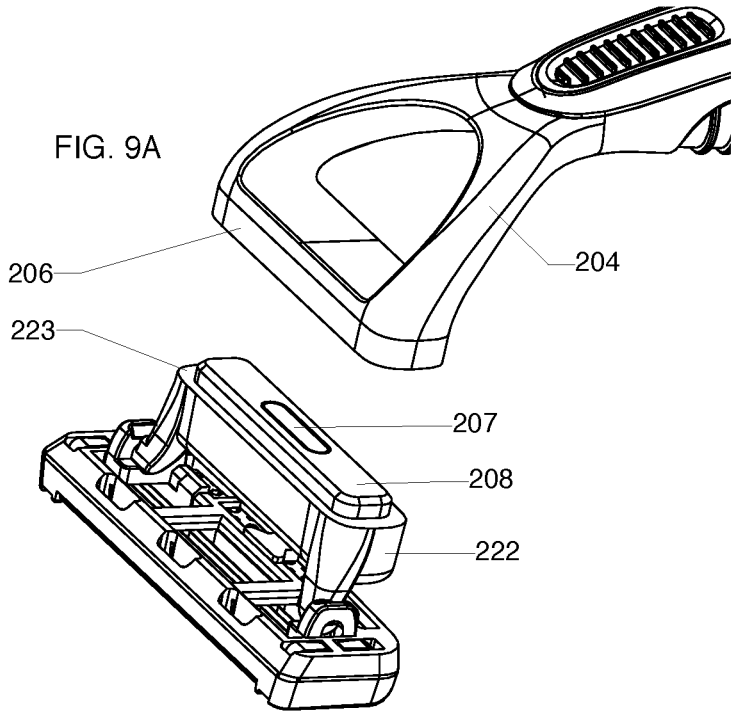
FIGS. 9A-9C show an alternate embodiment of the shaving system.
Figure 9B:
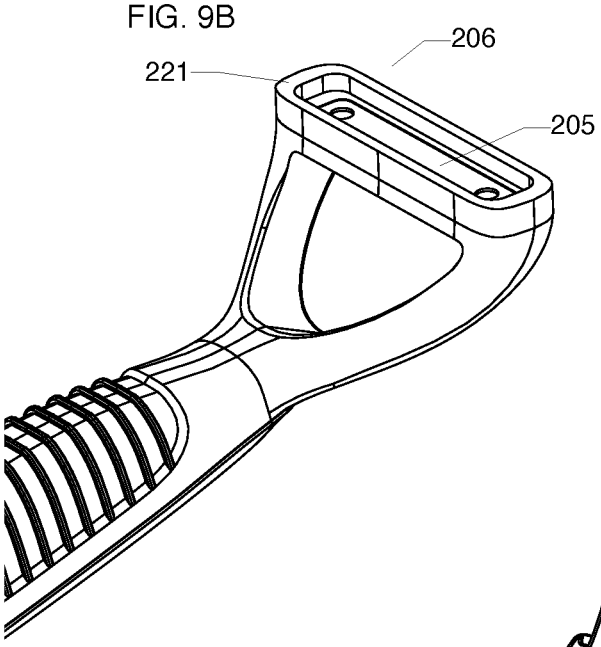
Figure 9C:
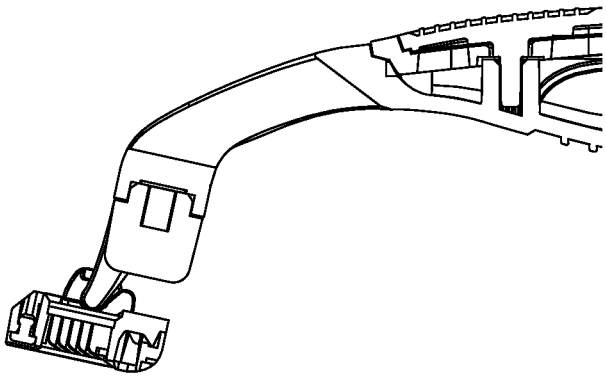

For example, as shown in FIGS. 9A-9C, while in the embodiment discussed above the appendage was on the handle, this arrangement can be reversed and the appendage 208 can protrude from the interface element 222 and be received in a magnetic receiver 206 disposed on handle 204. The receiver 206 is defined by a circumferential side wall that terminates in a top surface 221. When the appendage 208 is received by the receiver 206 the top surface 221 engages a rim surface 223 surrounding the appendage 208. In the embodiment shown in the figures, the magnet 207 is positioned on the appendage 208 and the ferrous strip 205 is positioned within the magnetic receiver 206. However, in either this embodiment or the one discussed with reference to FIG. 1, the positions of the ferrous strip and magnet can be reversed if desired. The ferrous strip is generally less expensive than the magnet, and thus it may be desirable to have the ferrous strip on the shaving assembly rather than on the handle regardless of the relative positioning of the appendage and receiver.

Moreover, the magnet and ferrous strip can be of any desired size and shape or material, provided they supply an adequate magnetic force. For example, it should be understood that appendage 108 could house any suitable number, size configuration, and shape of magnet(s) 107.

While one example of a blade unit is shown in the figures, the blade unit may have any desired configuration that is suitable to contact the skin and shave hair from the contact surface as the cartridge is drawn across the surface while applying a typical shaving force. Blade angles, the number of blades and the geometry of the cartridge assembly may be, for example, those generally utilized by those skilled in the shaving system art, for example as discussed in U.S. Pat. Nos. 7,448,135, 7,197,825, 7,765,700, and 7,621,203, the full disclosures of which are incorporated herein by reference. For example, blade unit 102 could include a blade, sharp edge, tapered edge or other type of hair removing surface that glides across the skin to preferably remove unwanted hair. Blade unit 102 could include a single blade, double blade or any suitable number of blades to shave hair. Blade unit 102 could be of any suitable size, shape or configuration.

Accordingly, the above description of example embodiments does not define or constrain this disclosure. Other changes, substitutions, and alterations are also possible without departing from the spirit and scope of this disclosure and the following claims.

What is claimed is:

1. A shaving system comprising:

a handle having a distal end and a proximal end, a shaving assembly mounted on the handle, and including an interface element configured to provide a mechanical engagement between the shaving assembly and handle, wherein the distal end of the handle includes an appendage protruding therefrom, and the interface element includes a receiving portion in form of a hollow, central cavity configured to receive the appendage, and a magnetic portion configured to provide a magnetic force between the handle and shaving assembly sufficient to retain the shaving assembly on the handle between shaving strokes;

wherein the magnetic portion comprises at least one magnet disposed in a recess at an end of the appendage, and a ferrous material disposed in the hollow, central cavity of the receiving portion, and wherein the appendage is substantially stationary relative to the receiving portion during shaving.

2. The shaving system of claim 1 wherein the interface element and a distal portion of the handle are configured to retain the shaving assembly on the handle when a shaving surface of the shaving assembly is in contact with a user's skin.

3. The shaving system of claim 1 wherein the appendage is disposed so that a long axis of the appendage is at an angle of +30 degrees to −30 degrees with respect to a crossbar center of the handle, and the handle further includes a generally planar rim surface surrounding the appendage that is configured to engage a corresponding rim surface on the interface element when the shaving assembly is mounted on the handle.

4. The shaving system of claim 3 wherein the rim surface on the handle is disposed at an angle of about 10 to 20 degrees with respect to a longitudinal axis of inertia of the handle.

5. The shaving system of claim 1 wherein the shaving assembly includes a blade unit that is mounted on the handle with a pivoting connection.

6. The shaving system of claim 1 wherein the pivoting connection between the handle and blade unit is configured to allow a user to rotate the handle between approximately 15 to 105 degrees from a reference skin plane during shaving.

7. The shaving system of claim 1 wherein the interface element includes tabs (103) configured to be grasped by a user to facilitate removal of the shaving assembly from the handle.

* * * * *